US005130758A

United States Patent [19]

Takeda et al.

[11] Patent Number: 5,130,758

[45] Date of Patent: Jul. 14, 1992

[54] IMAGE FORMING APPARATUS WITH MEANS FOR SEPARATING THE RECORDING MATERIAL FROM A CARRYING MEANS

[75] Inventors: Atsushi Takeda, Kawasaki; Takashi Hasegawa, Matsudo, both of Japan

[73] Assignee: Canon Kabushiki Kaisha, Tokyo, Japan

[21] Appl. No.: 774,658

[22] Filed: Oct. 15, 1991

Related U.S. Application Data

[63] Continuation of Ser. No. 504,039, Apr. 4, 1990, abandoned, which is a continuation of Ser. No. 332,721, Apr. 4, 1989, abandoned.

[30] Foreign Application Priority Data

Apr. 5, 1988 [JP] Japan ..... 63-083382
Apr. 5, 1988 [JP] Japan ..... 63-088383

[51] Int. Cl.[5] ..... G03G 15/00

[52] U.S. Cl. ..... 355/315; 355/271; 271/308

[58] Field of Search ..... 355/271, 274, 315, 326, 355/327; 271/308, 900

[56] References Cited

U.S. PATENT DOCUMENTS

| | | | |
|---|---|---|---|
| 3,955,889 | 4/1976 | Ishiguro et al. | 355/315 |
| 4,000,942 | 1/1977 | Ito et al. | 355/315 |
| 4,062,631 | 12/1977 | Ichikawa et al. | 355/315 |
| 4,065,120 | 12/1977 | Imaizumi et al. | 271/900 X |
| 4,072,412 | 2/1978 | Suda et al. | 355/274 |
| 4,119,308 | 10/1978 | Hamaker | 271/900 X |
| 4,327,991 | 5/1982 | Takeuchi et al. | 271/308 X |
| 4,370,051 | 1/1983 | Matsuyama et al. | 355/315 |
| 4,401,382 | 8/1983 | Minejima et al. | 355/315 |
| 4,561,760 | 12/1985 | Kawano et al. | 355/315 X |
| 4,571,056 | 2/1986 | Tani et al. | 355/315 X |
| 4,712,906 | 12/1987 | Bothner et al. | 355/271 |
| 4,806,985 | 2/1989 | Foley | 355/315 |

FOREIGN PATENT DOCUMENTS

| | | |
|---|---|---|
| 53-143341 | 12/1978 | Japan . |
| 55-32079 | 3/1980 | Japan . |
| 58-146263[U] | 10/1983 | Japan . |
| 60-27029 | 6/1985 | Japan . |

OTHER PUBLICATIONS

European Search Report dated Jan. 9, 1990.

*Primary Examiner*—Joan H. Pendegrass
*Attorney, Agent, or Firm*—Fitzpatrick, Cella, Harper & Scinto

[57] ABSTRACT

An image forming apparatus includes separating device. A recording material having an image is carried on a recording material carrying member. The separating member separates the recording material from the recording material carrying member. The separating member deforms the recording material carrying member in the form of a thin sheet, by pressing a roller to the recording material carrying sheet, thus facilitate insertion of a separating pawl between the recording material and the carrying sheet. By providing a single separating pawl, the probability of the erroneous separation is minimized. The recording material on the recording material carrying member is efficiently separated therefrom without damage to the recording material carrying member, thus providing a high quality of images.

82 Claims, 10 Drawing Sheets

IMAGE FORMING APPARATUS WITH MEANS FOR SEPARATING THE RECORDING MATERIAL FROM A CARRYING MEANS

This application is a continuation of application Ser. No. 07/504,039 filed Apr. 4, 1990 abandoned which is a continuation of application Ser. No. 07/332,721 filed Apr. 4, 1989, of which both are now abandoned.

FIELD OF THE INVENTION AND RELATED ART

The present invention relates to an image forming apparatus including separating means for separating a recording material on which an image is formed, from recording material carrying means for carrying the recording material, more particularly to a color image forming apparatus wherein a plurality of color images formed with toners on an image bearing member are superposedly transferred onto one and the same transfer material, and thereafter, the recording material is separated.

In a conventional image forming apparatus such as an electrophotographic copying apparatus wherein a toner image is formed on an image bearing member such as an electrophotographic photosensitive member and is transferred onto a transfer material, the transfer material is conveyed to the image bearing member carrying the toner image and is contacted to the image bearing member by which the toner image is transferred from the image bearing member to the transfer material; and in order to achieve this, there is provided an image transfer device.

Referring first to FIG. 11, the transfer device 10 includes a transfer material supporting or carrying member 11 usually in the form of a cylinder, a transfer material gripper 12 mounted on the transfer material carrying member 11 to grip a leading edge of the transfer material P supplied to the transfer material carrying member 11 and a transfer material carrying sheet (dielectric material sheet) 14 in the form of high resistance film for carrying the transfer material P, the transfer material carrying sheet being wrapped so as to cover an opening 13 (shown by broken lines) formed in the circumference of the transfer material carrying member 11.

With this structure, the leading edge of the transfer material P supplied to the transfer material carrying member 11 is gripped by a gripping pawl which is movable substantially vertically and which constitutes the transfer material gripper 12, and the remaining portion of the transfer material P is retained on the transfer material carrying sheet 14. The transfer material P gripped by the gripper 12 and retained on the transfer material carrying sheet 14 is brought into contact with the image bearing member by the rotation of the transfer material carrying member 11. At the transfer position, a corona discharger disposed inside the transfer material carrying member 11 applies to the backside of the transfer material carrying sheet the electric charge having a polarity opposite to that of the toner, or a conductive roller or the like applies a voltage having a polarity opposite to that of the toner, whereby the toner image is transferred from the image bearing member to the transfer material P.

In this image transfer process, the transfer material P now having the transferred image is subjected to AC discharge by an unshown discharger so as to weaken the attraction force between the transfer material P and the transfer material carrying sheet 14, and thereafter, separation pawls A are inserted between the transfer material and the transfer material carrying sheet, so that the transfer material is separated from the transfer material carrying sheet 14. As shown in Japanese Patent Application Publication 27029/1985, for example, a transfer material raising member (not shown) can be used at the gripper 12 in order to facilitate the insertion of the separation pawls A between the transfer material and the transfer material carrying sheet.

The conventional transfer device in the image forming apparatus, described above, wherein the transfer material P is gripped by the gripper 12 is advantageous, particularly when used with a color image forming apparatus, in that the transfer material P is positively supported on the transfer material carrying member 11 while the images are superposedly transferred onto the transfer material, and therefore, the registration among the different color images is good. However, when, for example, a plural number of image formations are to be executed continuously, and plural transfer materials P are supported on the transfer material carrying member 11 for the purpose of increasing the image forming speed, both the gripper and the transfer material raising member are required for the respective transfer materials so as to effect good separating operations, resulting in complicated structure. In addition, if a plurality of grippers and raising members are used, no image can be formed at the portion where the gripper and the raising member are disposed when a large size transfer material which is large enough to cover the plural grippers and the raising members is supported on the transfer material carrying member. For this reason, it has not been possible to provide a structure by which the transfer device is usable with plural sizes of the transfer materials.

U.S. Pat. No. 4,712,906 discloses that a surface of a transfer material is formed of a thin film of an elastomer, and a plurality of sucking chambers are disposed and arranged circumferentially in the transfer drum adjacent to the surface of the drum. The thin film of the elastomer is provided with sucking apertures communicating with the sucking chambers. The transfer material is attracted to the surface of the transfer drum through the sucking apertures so as to retain and carry the transfer material thereon.

With this means, it is not necessary for the transfer material to be gripped by the gripper. In addition, if plural sucking apertures are formed spaced in the circumferential direction of the transfer drum, plural transfer materials can be simultaneously retained and carried on the surface of the transfer drum.

Japanese Laid-Open Patent Application No. 32079/1980 discloses a transfer drum provided with a surface dielectric layer. In the transfer drum, a corona charger for attracting the transfer sheet (transfer material) is used, and a conductive roller or another charger having a polarity opposite to that of the corona charger for attracting the transfer sheet is disposed facing the corona charger. The transfer material is retained on the dielectric material sheet on the transfer drum surface by electrostatic attraction force and is carried thereon.

This transfer drum is advantageous in that it does not require a gripper or sucking device and can retain and carry the transfer sheet on the transfer drum with high efficiency.

In these two publications, when the transfer material is to be separated from the transfer drum surface, a separation pawl is inserted between the transfer material and the transfer drum surface.

However, when the separation pawl is strongly pressed to the sheet in an attempt to assure the separation, the sheet can be damaged resulting in deteriorated quality of the transferred image, and therefore, requiring that the sheet has to be exchanged frequently.

Conventionally, five to nine separation pawls A are used, which are disposed at regular intervals with a predetermined angle so that all of the separation pawls A have comparable separating functions. All of the separating pawls A are brought to the neighborhood of or in contact with the transfer material carrying sheet 14 in response to an operation signal produced by a control device (not shown) when the separating time comes. It separates the transfer material from the transfer material carrying sheet, and is returned to its home position in response to a releasing signal produced by the control device when the separating operation is completed.

The conventional separating means of the transfer device involves problems. Even if the edges of the plural separating pawls A are designed to be aligned relative to the transfer material carrying sheet, unavoidable variation in the positional accuracy of the edges during the manufacturing and assembling thereof can lead to insufficient separation of the transfer material. In addition, when the separating pawls A are contacted non-uniformly to the transfer material carrying sheet, the transfer material carrying sheet is deformed at plural positions, by which the space formed between the transfer material carrying sheet and the transfer material to allow the separation pawls A to enter becomes small, resulting in unstable separation.

If the separation pawls are strongly pressed to the transfer material carrying sheet in an attempt to assure the separation by the separating pawls, they can damage the transfer material carrying sheet resulting in deteriorated quality of the transferred image. This requires frequent exchanges of the transfer material carrying sheet.

Therefore, an image forming apparatus wherein the transfer material can be satisfactorily separated from the transfer material carrying member has been desired.

SUMMARY OF THE INVENTION

Accordingly, it is a principal object of the present invention to provide an image forming apparatus wherein a recording material carried on a recording material carrying member can be separated efficiently without damage to the recording material carrying member, whereby images having good quality can be provided.

In one embodiment of the invention, there is provided an image forming apparatus, comprising an image forming means for forming an image on a recording material, a movable and flexible recording material carrying means for carrying the recording material to an image forming position where said image forming means is located, and a separating means for separating the recording material from the recording material carrying means. The separating means includes means for deforming the recording material carrying means only when separating the recording material therefrom and the recording material carrying means includes a sheet member which is deformed by the deforming means for separating the recording material from the recording material carrying means.

In another aspect, there is provided an image forming apparatus, comprising a movable image bearing member, image forming means for forming an image on the image bearing member transfer means for transferring the image from the image bearing member to a recording material, a movable and flexible recording material carrying means for carrying the recording material to a transfer position where said transfer means is located and separating means for separating the recording material from the recording material carrying means, the separating means including deforming means for deforming said recording material carrying means upon separation of the recording material from the recording material carrying means.

In yet another embodiment of the invention, there is provided an image forming apparatus, comprising a movable image bearing member, means for transferring the image from the image bearing member onto a recording material, movable recording material carrying means for carrying the recording material to a transfer position where said transfer means is located, and separating means for separating the recording material carried by said recording material carrying means from the recording material carrying means. The separating means has a first separating member which is first inserted between the recording material and the recording material carrying means and a second separation member which is inserted therebetween after the first separating member is inserted.

In still another embodiment of the invention, there is provided an image forming apparatus, comprising image forming means for forming an image on a recording material; a movable and flexible recording material carrying means for carrying the recording material to an image forming position where said image forming means is located and separating means for separating the recording material carried by the recording material carrying means from the recording material carrying means. The separating means includes means for deforming the recording material carrying means only when separating the recording material therefrom and includes a separating member insertable between that side of the recording material which does not have the image and the recording material carrying means upon the separating operation.

This and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 7:
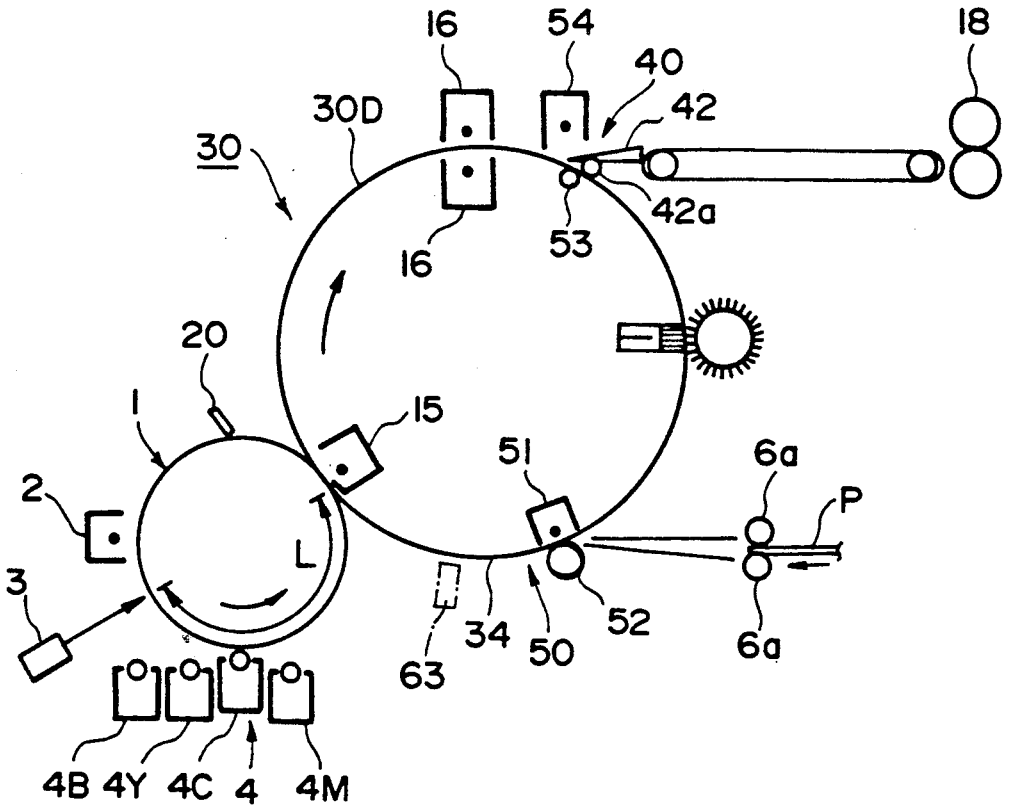
FIG. 7 is a sectional view of an image forming apparatus according to an embodiment of the present invention.

Referring to FIG. 7, there is shown a color electrophotographic apparatus as an exemplary image forming apparatus according to an embodiment of the present invention. In this embodiment, an image bearing member, that is, an electrophotographic photosensitive drum 1 which is rotatably supported for rotation in the direction indicated by an arrow is uniformly charged by a primary charger 2, and then is exposed to light image 3 corresponding to image information by exposure means including a laser beam exposure means or the like, so that an electrostatic latent image is formed on the photosensitive drum 1. The electrostatic latent image is visualized as a toner image on the photosensitive drum 1 by a movable type developing device 4, for example.

In this embodiment, the photosensitive drum 1 is an OPC (organic photoconductor) drum 1 having a negative charging property and is negatively charged by the primary charger 2, and the portion which is to receive the toner is exposed to light by the exposure means so that the potential of that portion is attenuated, whereby the latent image is formed.

The latent image is reverse-developed by negatively charged toner particles in the developing device 4.

The movable developing device 4 comprises, in this embodiment, four developing devices 4M, 4C, 4Y and 4B containing magenta color developer, cyan color developer, yellow color developer and black color developer, respectively, and a guide (not shown) for guiding the four developing units for movement in a horizontal plane. In the movable developing device 4, a desired developing unit is brought to a developing position where it faces the outer periphery of the photosensitive drum 1, to develop the electrostatic latent image on the photosensitive drum 1.

The recording material (transfer material) P is carried by the transfer device 30 which will be described in detail hereinafter, and is conveyed by the developing device 30 in the direction indicated by an arrow in the Figure, and is brought into contact to the photosensitive drum 1 and receives the toner image which has been formed on the photosensitive drum 1 as the visualized image. The transfer material P is supplied to the transfer device 30 in synchronism with the image on the photosensitive drum 1 by the registration roller 6A.

The residual toner particles remaining on the photosensitive drum 1 surface is removed by the cleaning device 30, so that the photosensitive drum 1 is prepared for the repeated color image forming process.

Figure 1:
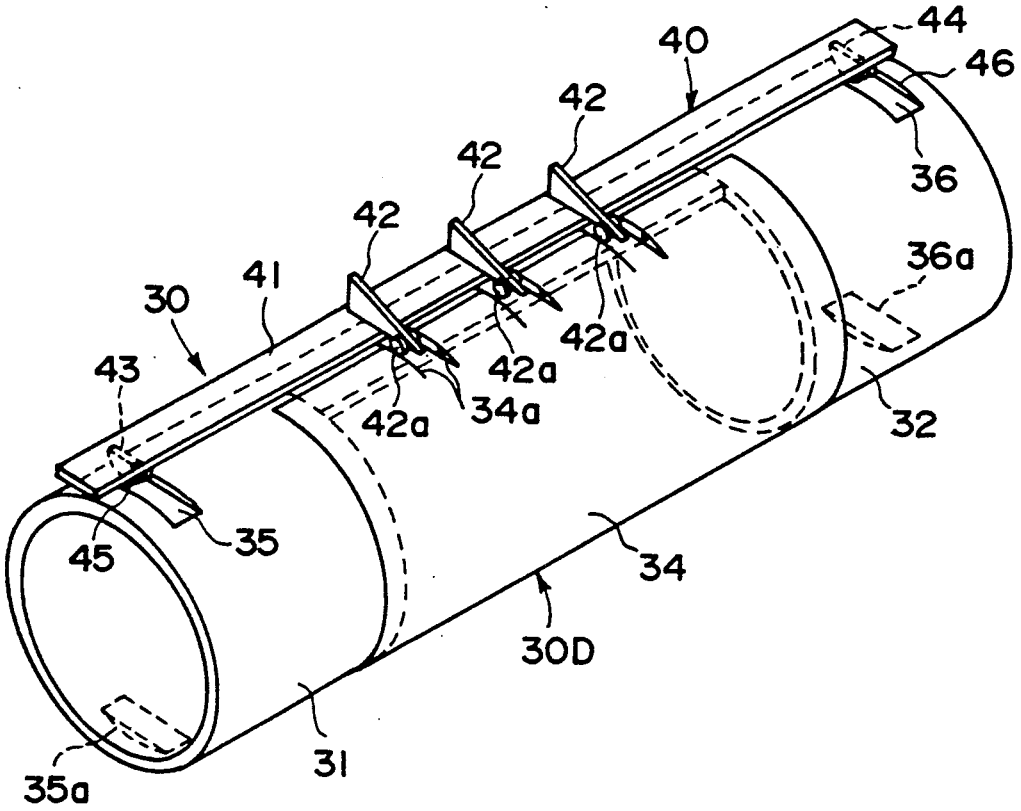
FIG. 1 is a perspective view of a transfer device usable with an image forming apparatus according to an embodiment of the present invention.
Figure 2:
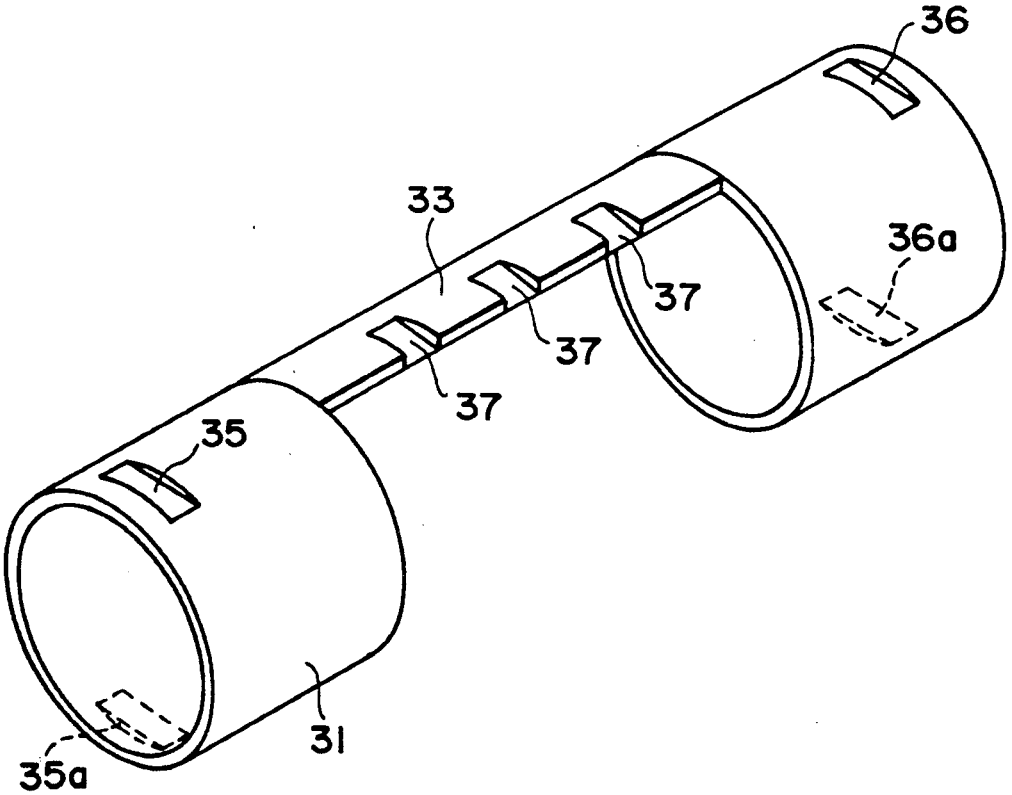
FIG. 2 is a perspective view of a transfer drum frame of the transfer device of FIG. 1.

Referring now to FIGS. 1 and 2, an example of the transfer device 30 used with the color electrophotographic apparatus according to an embodiment of the present invention will be described. In this embodiment, the transfer device 30 comprises cylindrical rings 31 and 32 at opposite longitudinal ends and a connecting portion 33 for connecting the rings 31 and 32. The rings 31 and 32 and the connecting portion 33 constitute a transfer drum frame for supporting a transfer material carrying sheet 34 which is a transfer material supporting member, including dielectric material film.

Figure 3A:
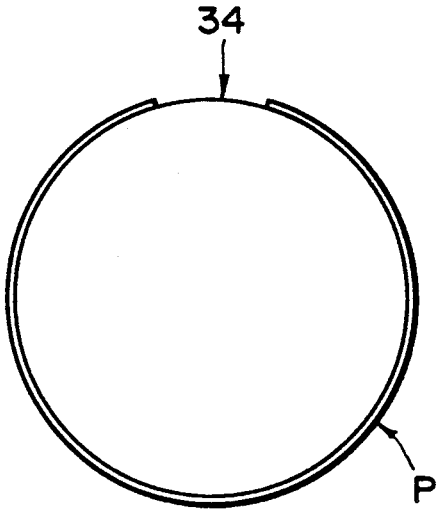
FIGS. 3A and 3B illustrate the transfer materials wrapped around the transfer drum.
Figure 3B:
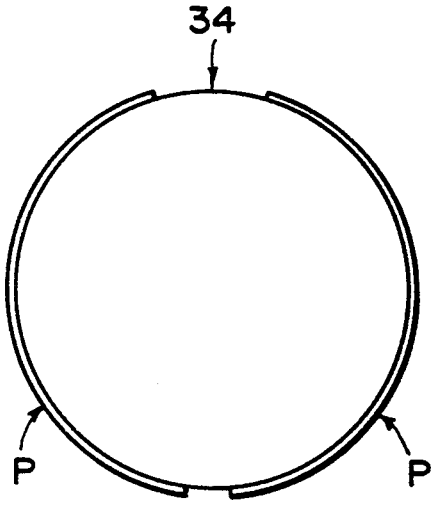

In this embodiment, the drum frame wrapped with the transfer material carrying sheet constitutes an image transfer drum 30D. The transfer drum 30D has an outer diameter of 160 mm, in this embodiment. As shown in FIGS. 3A and 3B, the circumferential length of the transfer drum 30D has a circumferential length sufficient to carry one A3 size sheet or one B4 size sheet with the length of the sheet being codirectional with the circumferential direction of the transfer drum, and also sufficient to carry two A4 size sheets or two B5 size sheets with the length of the sheets being codirectional with the longitudinal direction of the transfer drum.

In FIG. 3B, there is a space between the two transfer materials P carried on the transfer material carrying sheet 34, but this space is not inevitable, the space between the transfer materials P may be eliminated.

In this embodiment, it is possible that the size of the transfer material used is detected by detecting means, and also the number of sheets to be subjected to the image forming operation is detected by detecting means, and in response to those detections, a CPU can decide whether one or two transfer materials are wrapped on the transfer drum.

Figure 12:
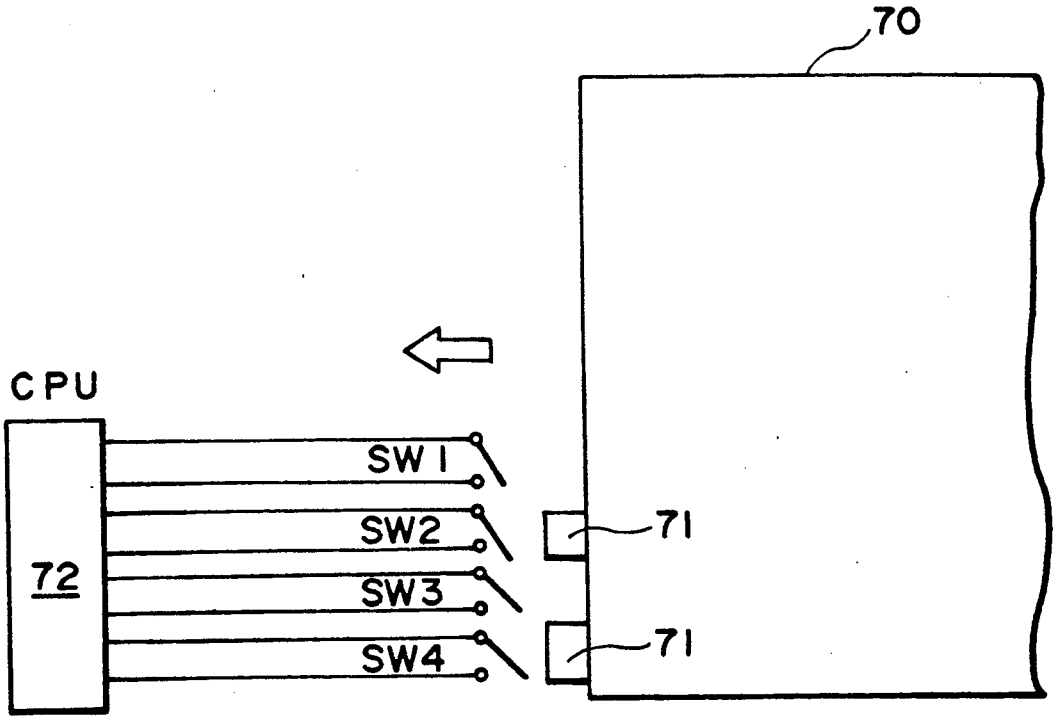
FIG. 12 illustrates means for detecting sizes of the transfer materials.

As shown in FIG. 12, the transfer material size detecting means may comprise projections 71 provided on the cassette 70 for accommodating the transfer materials and microswitches SW1–SW4 on the image forming apparatus which are selectively depressed by the projections 71 when the cassette 70 is set in the apparatus. The configuration of the projection 71 is different depending on the size of the transfer material contained in the cassette, and therefore, the microswitch or microswitches depressed by the projection 71 are different. In response to the selective actuation of the microswitch, the signal is introduced into the CPU 72, and the number of the copies to be taken is set in the CPU 72 by an unshown input button. On the basis of those settings, the CPU 72 decides how many transfer materials P are attracted on the transfer drum, and it controls the attracting operation.

In this embodiment, the transfer device 30 further includes separating means 40 which comprise a separation pawl supporting member 41 arranged along an axis of the transfer drum 30D and plural, three in this embodiment, separation pawls 42 fixed on the supporting member 41. The separating pawl 42 is provided at its end integrally with a roller 42a which is pressed to the outside of the transfer drum 30D to perform the function which will be described hereinafter. As will be understood from FIGS. 1–4, at the opposite ends of the supporting member 41, pressing rollers 45 and 46 are disposed through supporting plates 43 and 44. The pressing rollers 45 and 46 are contacted to the rings 31 and 32 of the transfer drum 30D when a half turn clutch 74 for operating the separation pawl operates. The rollers 45 and 46 are guided by the guiding grooves 35 and 36 formed in the rings 31 and 32 to rotate the separation pawl 42 to move its end downwardly, that is, in the direction substantially perpendicular to the surface of the transfer drum 30D.

Figure 13A:
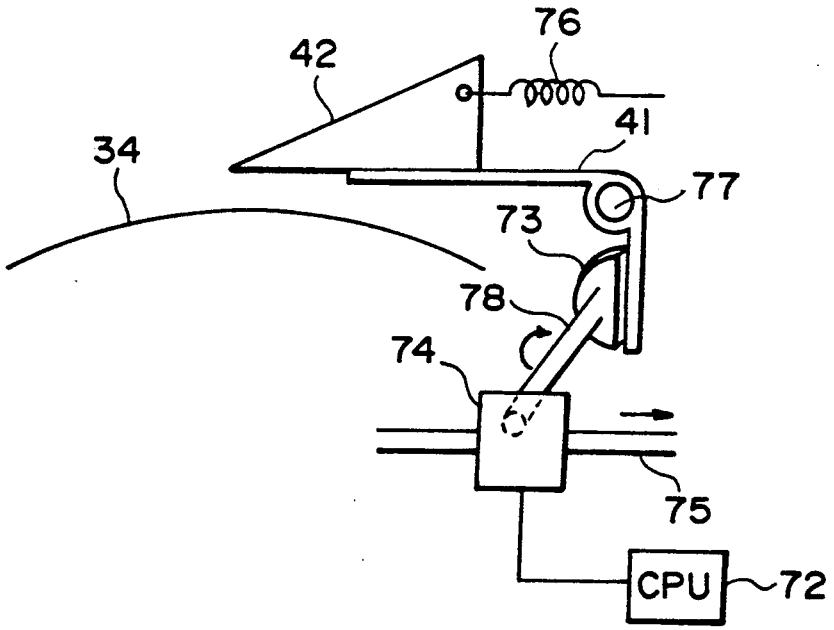
FIGS. 13A and 13B illustrate the separating action by the separating means.
Figure 13B:
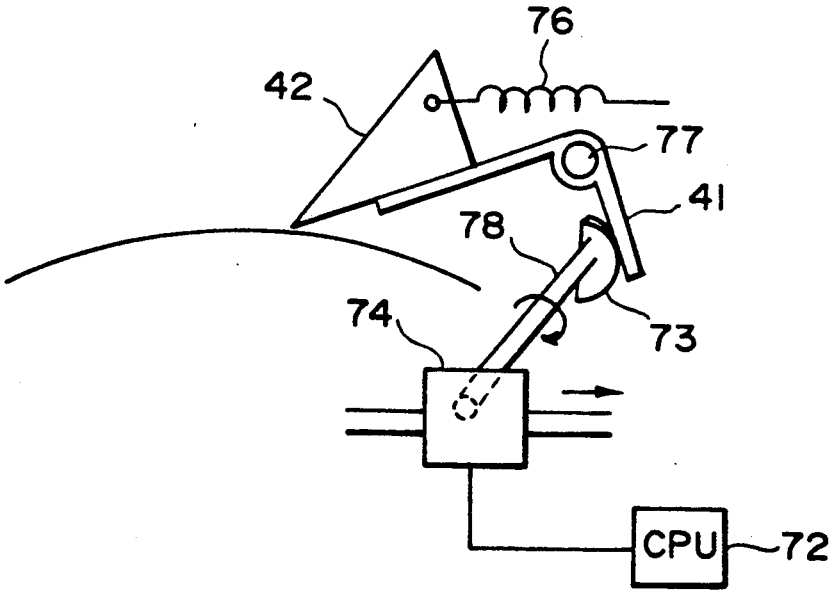

Referring to FIGS. 13A and 13B, description will be made as to the operation of the separation pawl 42. As shown in FIG. 13A, the separation pawl 42 is urged rightwardly by a spring 76, but is normally maintained at its non-operative position wherein it does not perform the separating operation. The supporting member 41 for supporting the separation pawl 42 is rotatable about a shaft 77. The supporting member 41 is driven by an actuating plate 73 having a generally a part-circular (half-circular) disk supported on an output shaft 78 of a half turn clutch 74 controlled by the CPU 72. When the half turn clutch 74 takes its engaging position, the driving force is transmitted to the output shaft 78 through driving means 75 in the form of a belt or chain. When the separating pawl 42 performs its separating action, a signal is produced from the CPU 72, and the shaft 78 is rotated through one half turn by the half turn clutch 74 taking its engaging position, from the state shown in FIG. 13A. Therefore, the actuating plate 73 rotates the supporting member 41 about the shaft 77 in the counterclockwise direction to move the separating pawl 42 to its operating position wherein it performs the separating function, as shown in FIG. 13B. After the separating operation, the shaft 78 rotates through one half turn by the half turn clutch 74, and the restoring force of the spring 76 rotates the supporting member 41 and the separating pawls 42 in the clockwise direction to return them to the non-operative position shown in FIG. 13A.

Although not shown in FIGS. 13A and 13B, the rollers 42a, 45 and 46 and the separating plates 43 and 44 make the same motion as the separating pawls 42 and the supporting member 41.

Figure 5:
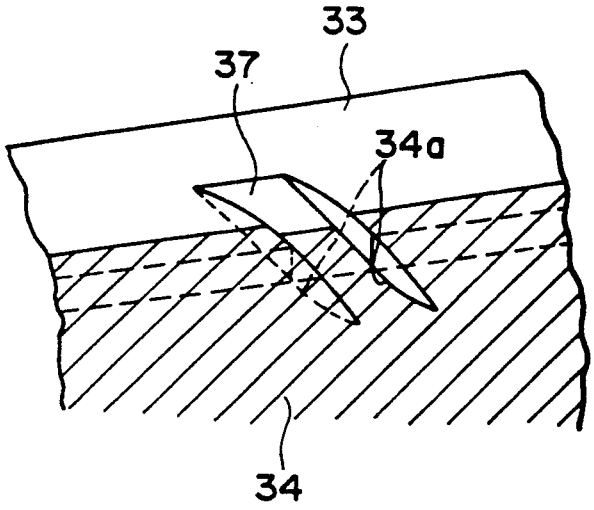
FIG. 5 is a perspective view illustrating the relationship between a connecting portion and the transfer sheet in the transfer device of FIG. 1.

The connecting portion 33 is provided with cut-away portions 37 to assist or facilitate insertion of the separating pawls 42 between the transfer material carrying sheet 34 and the transfer material P attracted and carried on the transfer material carrying sheet 34. As shown in FIGS. 1 and 5, the edge of the transfer material carrying sheet 34 is provided with cuts 34a along the cut-away portions 37 of the connecting portion 33 within a non-image-forming region of the transfer material in which the toner image is not transferred onto the transfer material. Therefore, the transfer material carrying sheet 34 indicated by hatching in FIG. 5 is bonded to the connecting portion 33 so as to provide local large curvature portions.

The transfer device 30 includes transfer material attracting means 50 for attracting and retaining on the transfer material carrying sheet 34 the transfer material P supplied to the transfer device. As shown in FIG. 7, the transfer material attracting means 50 includes an attracting corona charger 51 which is disposed within the transfer drum 30 and which applies to the back side of the transfer material carrying sheet electric charge having a polarity opposite to that of the toner image on the photosensitive drum 1, that is, the positive charge in this embodiment, and a conductive roller 52 disposed outside of the transfer drum 30D. The conductive roller 52 is grounded and functions as an opposite electrode of the attracting corona charger 31 to inject the electric charge into the transfer material P and to electrostatically attract the transfer material P to the transfer material carrying sheet 34.

Preferably, the transfer material P is supplied such that the non-image-forming region at its leading edge is overlapped with the cuts 34a of the transfer material carrying sheet 34 and is not overlapped with the image forming region. As for the continuous image formation, when the length of the transfer material measured along the direction of the transfer material transportation is less than a half of the circumferential length of the transfer drum capable of supporting the transfer material, two transfer materials are retained on the transfer material. More particularly, when the length of the sheet used is less than one half the length which is the circumferential length of the transfer drum subtracted by the width of the connecting portion, the second transfer material is supplied subsequently to the first sheet, so that the second transfer material is attracted on the transfer material carrying sheet 34 in the position diametrically opposite to the first transfer sheet, as shown in FIG. 3B. Thus, two transfer materials P are simultaneously retained on the transfer material carrying sheet.

The transfer material P attracted by the transfer device 30 is conveyed to the image transferring operation position where the transfer charger 15 is disposed. In the transferring position, the image transfer corona charger 15 applies to the back side of the transfer material carrying sheet 34 a electric charge having the polarity opposite to that of the toner, thus transferring onto the first transfer material P the toner image formed with the first color developer, the magenta toner, for example. Subsequently, the same latent image is formed on the photosensitive drum, which is developed with the same, that is, the first color toner, which is in turn transferred onto the second transfer material P retained on the transfer material carrying sheet 34. Prior to the first transfer material reaching for the second time the conductive roller 52, the conductive roller 52 is released so that it is moved away from the transfer material carrying sheet 34, through, for example, not less than 2 mm, to a position where it does not disturb the toner image transferred onto the transfer material P.

A second toner image is formed on the photosensitive drum in synchronism with the first transfer material having received the first color image and is transferred onto the first transfer material P by the transfer corona charger 15. Similarly, the second transfer material having received the first color toner image receives the second color toner image. In the similar manner, the two transfer materials P receive four color toner images, respectively.

The transfer device 30 is provided with a pair of AC corona dischargers 16 at opposite sides of the transfer material carrying sheet 34 so as to weaken the attracting force between the transfer material and the transfer material carrying sheet after completion of the image transferring operation. It is effective to electrically discharge the transfer material P and the transfer material carrying sheet 34.

In order to separate the first transfer material P from the transfer material carrying sheet 34, the pressing rollers 45 and 46 are moved together with the supporting member 41 for the separating means 40 by the half turn clutch 74 for actuating the separating pawls, as will be understood from FIGS. 1, 4, 13A and 13B, so that they are contacted to the rings 31 and 32 of the transfer drum 30D. They are guided by the guiding grooves 35 and 36 of the rings 31 and 32. By this, the edges of the separating pawls 42 are rotated downwardly, that is, in the direction perpendicular to the transfer drum 30D surface toward the transfer material carrying sheet 34, whereby the pressing roller 42*a*, moved integrally with the separating pawl supporting member 41, is pressed to the transfer material carrying sheet 34. The pressing roller 42*a* moves along the cut-away portion 37 of the connecting portion 33, and the separating pawl 42 wedges between the edge of the first transfer material and the transfer material carrying sheet 34 at the position where the curvature of the transfer material carrying sheet 34 is locally different, so that the transfer material P is separated from the transfer material carrying sheet 34. In this manner, the leading edge of the transfer material is separated from the transfer material carrying sheet 34 by deformation of the transfer material carrying sheet 34, and therefore, the separating pawls 42 do not directly damage the transfer material carrying sheet 34, so that good transferring operation is assured. At this time, the inside separation roller 53 which is to be pressed to the inside of the transfer material carrying sheet is not driven.

Figure 4:
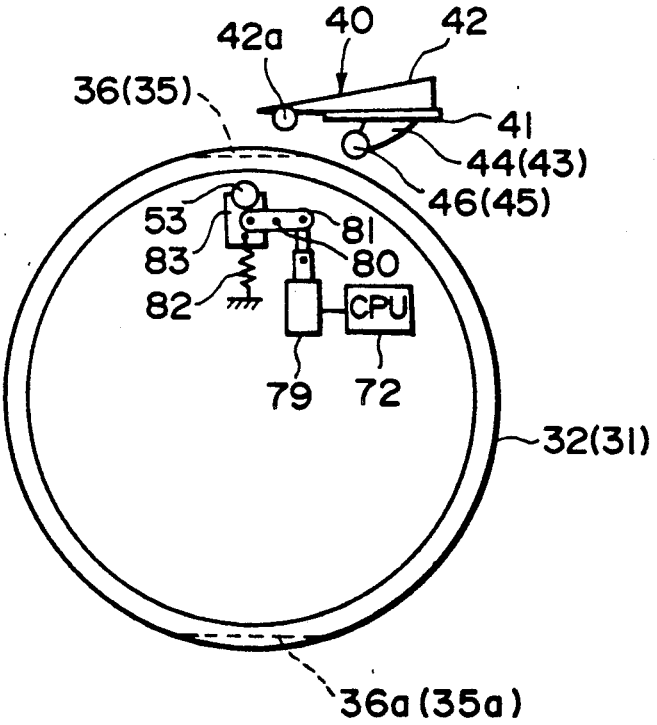
FIG. 4 is a side view of separating means used in the transfer device of FIG. 1.

Referring back to FIGS. 4 and 6, when the second transfer material P is to be separated from the transfer material carrying sheet 34, the inside separating roller 53 disposed within the transfer drum 30D is pressed to the inside of the transfer material carrying sheet 34 by energization of the solenoid 79 controlled by the CPU 72. As shown in FIG. 4, the solenoid 79 is coupled by a coupling member 81 to the supporting member 83 for supporting the inside separating roll 53. The coupling member 81 is rotatable about a shaft 80 and is rotatably joined with the supporting member 83 and with the solenoid 79. The supporting member 83 is urged downwardly by the spring 82. Therefore, as described hereinbefore, when the solenoid 79 is energized in the state shown in FIG. 4, the coupling member 81 rotates clockwisely about the shaft 80 to raise the roller 53 supported on the supporting member 83 to provide the state shown in FIG. 6. When the solenoid 79 is deenergized, the state of FIG. 4 is restored.

The outside separating pawl 42*a* is also pressed to the outside of the transfer material carrying sheet 34 by the pressing rollers 45 and 46 of the separating means 40 being guided along the grooves 35*a* and 36*a* formed at the opposite side of the connecting portion 33 for connecting the rings 31 and 32. As will be understood, the curvature of the transfer material carrying sheet is locally changed by the roller 42*a*, so that the edge of the transfer material is separated by the curvature change, and the separation is completed by inserting the separating pawl 42 between the transfer material P and the transfer material carrying sheet 34. In this embodiment, when the transfer material carrying sheet is deformed, both the outside separating roller 42*a* and the inside separating roller 53 are operated, but only one of them is actuated to deform the sheet.

It is preferable that a corona discharger 54 is used to perform an AC corona discharging operation so as to prevent disturbance to the image due to separation discharge which is produced when the transfer material P and the transfer material carrying sheet 34 are separated.

When the length of the transfer material measured in the transfer material conveying direction is longer than the above-described (FIG. 3A), the leading edge of that the transfer material P is attracted on the transfer material carrying sheet 34 at the same position as the first transfer material described above, and the image transferring and the transfer sheet separating operations are performed in the same manner as the first transfer material described hereinbefore. At this time, the inside separating pawl 53 is not driven.

After the image transferring and the transfer material separating operations are completed, the transfer material P is conveyed to the fixing device 18, where the toners are mixed and fixed by application of heat thereto. Then, the transfer material is discharged so that the image forming operation is completed.

Figure 14:
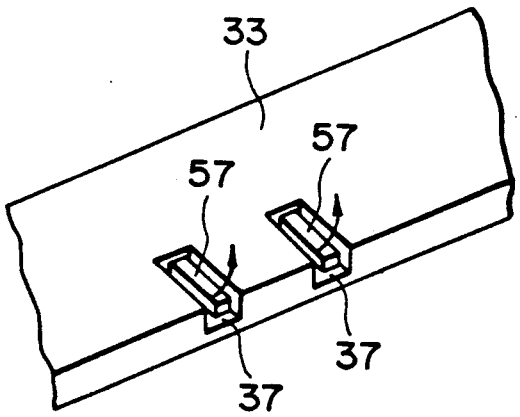
FIG. 14 is a perspective view illustrating the relationship between the connecting portion and the transfer sheet in the transfer device.

FIG. 14 illustrates a transfer device 30 according to another embodiment of the present invention. In this embodiment, a raising member 57 for raising the leading edge of the first transfer material toward the outside of the transfer material to separate it, is additionally provided in the cut-away portion 37 formed in the connecting portion 33 of the transfer drum frame. The first transfer material P is supplied in such a manner that it is attracted with its non-image-forming region (adjacent its leading edge) above the raising member 57. After the four color toner images are transferred from the photosensitive drum 1 onto the transfer material P supported on the transfer material carrying sheet 34, the raising member 57 is driven in the direction of an arrow at the position of the separating pawl 42 so as to separate the leading edge of the transfer material from the transfer material carrying sheet and so as to introduce the separating pawls 42 between the transfer material P and the transfer material carrying sheet 34, thus effecting the transfer material separating function. The separation of the second transfer material when two transfer materials are attracted on the transfer material carrying sheet 34, is the same as described with respect to FIGS. 4 and 6, that is, by deformation of the transfer material carrying sheet 34. Here, a gripper or grippers for gripping the transfer material may be employed in addition to the raising member.

The separation by deformation of the transfer material carrying member according to the present invention is applicable to a transfer device wherein the transfer material is sucked on a transfer drum surface.

Figure 8:
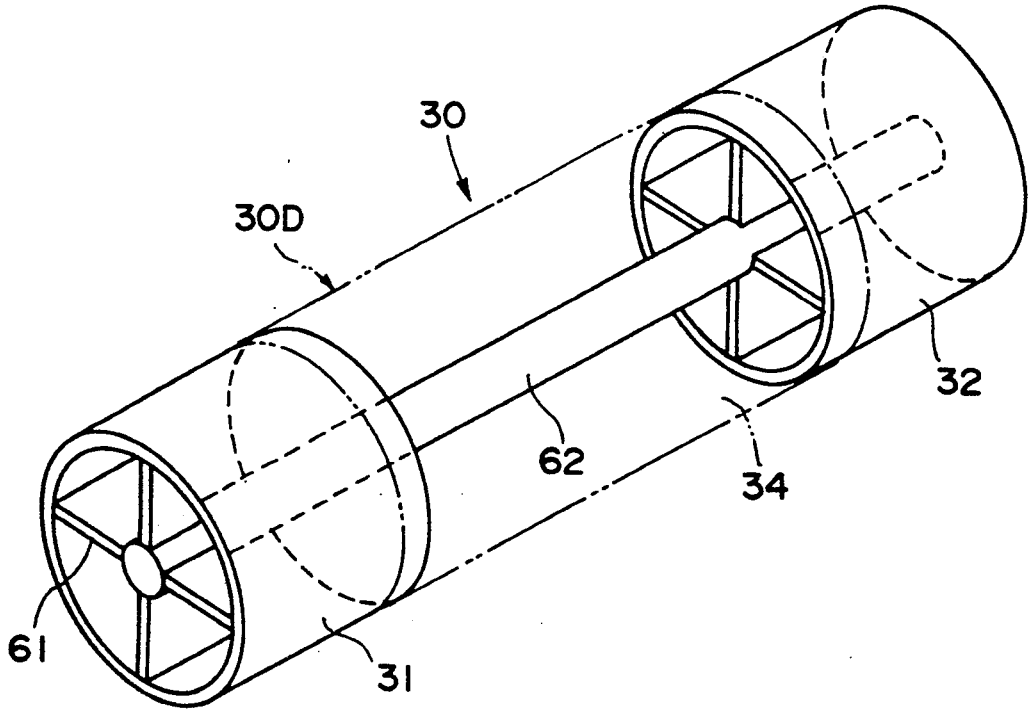
FIG. 8 is a perspective view of a transfer device according to another embodiment of the present invention.

Referring to FIG. 8, there is shown a further embodiment of the transfer device 30. In the foregoing embodiment shown in FIG. 2, the transfer drum frame is constituted by rings 31 and 32 and connecting portion 33 therebetween, and the transfer material carrying sheet 34 is wrapped around the frame, and therefore, the transfer material attracting position on the transfer material carrying sheet 34 is determined. In the present embodiment, the transfer drum D is constituted by rings 31 and 32 which are fixed to a central supporting shaft 62 by proper supporting members 61 to constitute a transfer drum frame. On the frame, a seamless transfer material carrying sheet 34 is wrapped.

In this embodiment, the transfer material carrying sheet 34 is in the form of a seamless cylinder, and therefore, the transfer material can be supported thereon at any position. The transfer material P can be supplied without strict control relative to the rotational position of the transfer drum. The transfer material P is attracted on the transfer material carrying sheet 34 by the attracting corona charger 51 and the conductive roller 52.

As shown in FIG. 7, when such a transfer device 30 is used, a transfer material detecting sensor 63 is disposed downstream of the attracting means 50 to detect the position of the transfer material. The transfer material detecting sensor 63 is disposed upstream of the transfer position by a distance on the circumference of the transfer drum 30, which is longer than a distance L from the image exposure position to the image transfer position measured along the circumference of the photosensitive drum 1. As for the continuous copying operation, when the length of the transfer material measured along its conveyance, is less than one half of the circumferential length of the transfer drum, the second transfer material is supplied sequentially. It is detected by the transfer material detecting sensor 63, and thereafter, the latent image is formed on the photosensitive drum 1 in synchronism with the detected transfer material, and the image is developed and transferred onto the transfer material.

Figure 6:
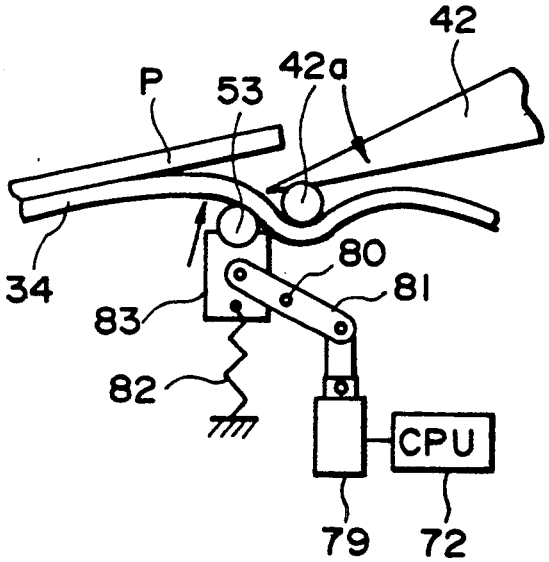
FIG. 6 illustrates a separating action by the separating means.

In this embodiment, the four color toner images on the photosensitive drum 1 are sequentially transferred and the first and second transfer materials P on the transfer drum are separated. During the separating operation, as shown in FIG. 6 the inside separating roller 53 and the outside separating roller **42*a* movable together with the separating pawls 42 are pressed to the transfer material carrying sheet 34 to locally change the curvature of the transfer material carrying sheet 34, thus separating the leading edge of the transfer material by the curvature, and the separation is completed by inserting the separating pawls 42** between the transfer material and the transfer sheet.

Figure 10:
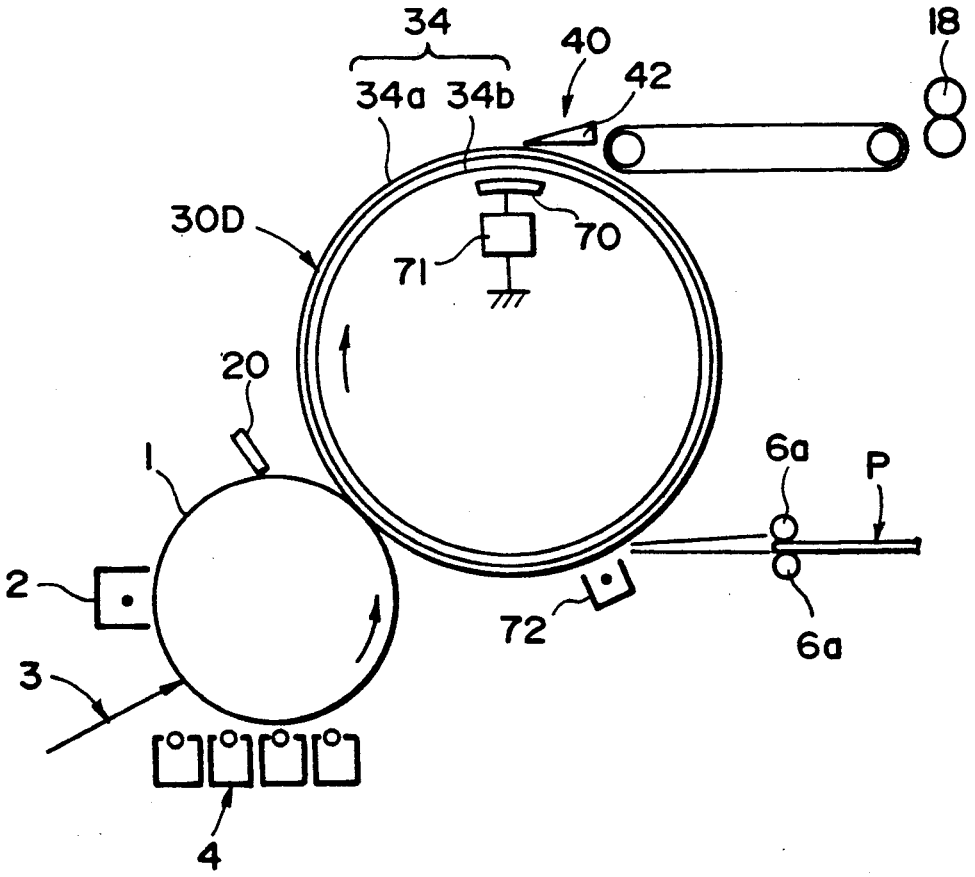
FIG. 10 is a sectional view of a color electrophotographic copying apparatus according to another embodiment of the present invention.
Figure 11:
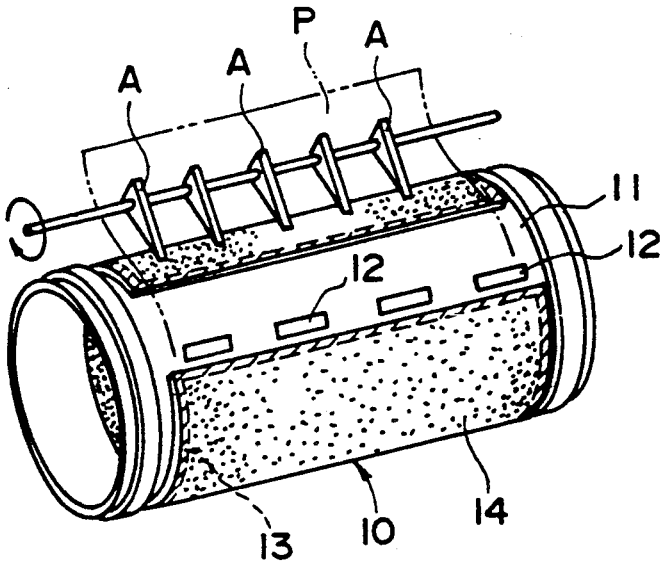
FIG. 11 is a perspective view of a conventional transfer device.

Referring to FIG. 10, there is shown a transfer device according to another embodiment of the present invention. In this embodiment, the transfer device 30 includes, in place of the transfer material carrying dielectric film 34 described in the foregoing embodiments, a transfer material carrying sheet 34 having an insulating layer **34*a* contactable to the transfer material and a backing conductive layer 34*b*. The conductive layer 34*b* of the transfer material carrying sheet 34 is electrically isolated from the rings 31 and 32 constituting the transfer drum frame, and a DC bias voltage of a predetermined level is applicable to the conductive layer 34*b***, although it is not shown in the Figure.

When the transfer material P is conveyed to the transfer drum 30D, the conductive layer **34*b* is supplied with a bias voltage having a polarity opposite to that of the toner image on the photosensitive drum 1, and simultaneously, the attracting corona charger 72 is energized so that it is weakly discharged toward the same polarity as the toner image. For example, when the polarity of the toner is negative, the discharge current of the attracting corona discharger is −5 micro-ampere, and the bias voltage is +1.5 KV, by which the transfer material P can be property attracted and carried on the transfer material carrying sheet 34, and also the toner image can be transferred onto the transfer material P from the photosensitive drum 1**. If the apparatus is operated in the full-color production mode, the second and subsequent toner images are properly superposedly transferred if the bias voltage is incremented successively with 500 V for example.

In this embodiment, the separating means 40 includes separation pawls 42 and a transfer material separating electrode 70 facing the separation pawls 42, wherein the electrode 70 is electrically connected to a DC source 71.

As for the transfer material separating operation, when the leading edge of the transfer material P comes to the neighborhood of the separating pawl 42, the electrode 70 which is disposed away from the transfer material carrying sheet 34 by approximately 7 mm for example, is supplied with a voltage having a polarity opposite to that of the voltage applied to the conductive layer **34*b* of the transfer material carrying sheet 34, for example, a voltage providing a potential difference of approximately 4 KV from the transfer material carrying sheet, for example. The portion of the transfer material carrying sheet 34 facing the electrode 70 is electrostatically attracted to the electrode 70, by which the transfer material carrying sheet 34 is locally deformed to provide a larger curvature thereof. Therefore, the transfer material is separated from the transfer material carrying sheet at the deformed portion, and the separating pawls are introduced between the separated transfer material and the transfer material carrying sheet to complete the separation therebetween. The separated transfer material is conveyed to a fixing device 18** where the images are mixed and fixed. Thereafter, the transfer material is discharged.

Figure 9:
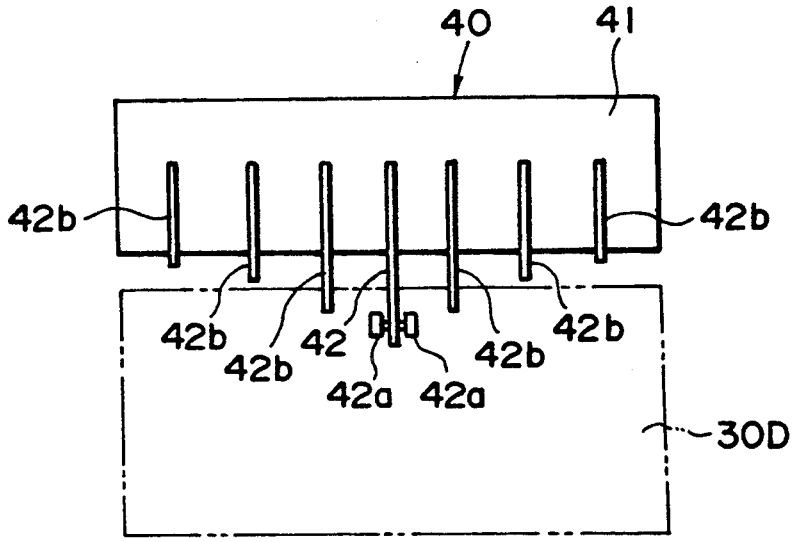
FIG. 9 is a top plan view of separating means of the transfer device according to another embodiment of the present invention.

Referring to FIG. 9, there is shown another embodiment of the separating means 40' usable with the transfer device according to the present invention. The separating means 40' has the same structure as the separating means described in conjunction with FIG. 1. However, as shown in FIG. 9, the arrangements of the separating pawls 42 are different. More particularly, the central separating pawl 42 is closest to the transfer drum D, and auxiliary separating pawls **42*b* at both sides thereof are shorter toward the longitudinal ends of the transfer drum D. Further, an outer separating roller 42*a* is integrally mounted only to the central separating pawl 42**.

With the separating means 40' thus contracted, the deforming means constituted by the outer separating roller **42*a* associated with the central processing pawl 42 and the inner separating roller 53, is first pressed to the transfer material carrying sheet, during the separating operation, by which the transfer material carrying sheet 34 is locally deformed to provide a different curvature thereof, by which the leading edge of the transfer material is separated from the transfer material carrying sheet 34. Subsequently, the central separating pawl 42 which is closest to the transfer material is first introduced between the transfer material P and the transfer material carrying sheet 34. With advancement of the transfer material P, the transfer material P is gradually raised to expand the separated region so that the auxiliary separating pawls 42*b* are inserted between the transfer material P and the transfer material carrying sheet 34**, thus further expanding the separated region to complete the separation between the transfer material and the transfer material carrying sheet.

In this embodiment, since the transfer material carrying sheet 34 is deformed at one position, it is easy to locally to deformed the transfer material carrying sheet.

Here, it is not inevitable that the inner separating roller 53 is employed.

In the foregoing embodiments, the description has been made as to the case where the transfer material carrying sheet of the transfer drum is deformed to separate the transfer material from the transfer drum, but the present invention is not limited to this case. Rather, as the means for carrying the transfer material, it may be a photosensitive belt which functions as the image bearing member, too, wherein the photosensitive belt may be deformed when a transfer material is to be separated from the photosensitive belt.

Various experiments and investigations made by the inventors have revealed that if the number of separation pawl which are to be inserted between the transfer material carrying sheet and the transfer material at least at the time of the start of the separation therebetween is one, the transfer material can be more effectively separated from the transfer material carrying sheet. Even if the transfer material is electrostatically attracted to the transfer material carrying member such as the transfer material carrying sheet, the transfer material can be very effectively separated from the transfer material carrying member by a single separation pawl. From the standpoint of statistics of separation, if there are n separation pawls each having a probability N of erroneous separation, the probability of at least one separating pawl failing, is $$N' = \sum_{k=1}^{n} nCk \cdot N^k \cdot (1 - N)^{n-k}$$

where n is positive integer not less than 2.

Therefore, $N<N'$, and therefore, the separation by a single separating pawl is efficient.

Figure 15:
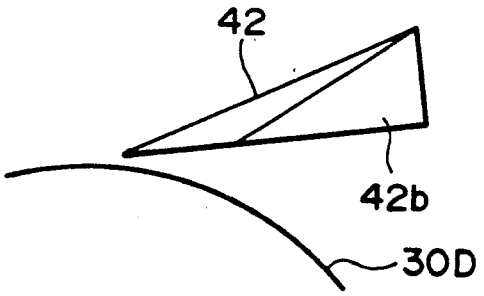
FIGS. 15 and 16 are side views illustrating the relationship between a separating pawl and an auxiliary separating pawl.
Figure 16:
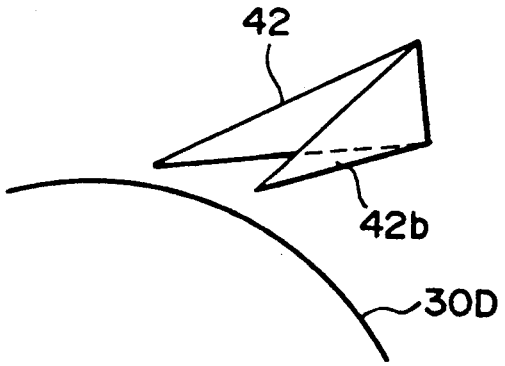

Referring to FIGS. 15 and 16, there are shown side views of the separating pawl 42 and a auxiliary separating pawl **42*b*. As shown in FIG. 15, the positions of the edges of the auxiliary separating pawls 42*b* may be changed in a single plane so as to be spaced more from the transfer drum 30D toward the longitudinal ends, or the positions thereof may be changed three-dimensionally, as shown in FIG. 16**. The latter case is particularly effective when the transfer material is soft so that the rigidity of the sheet can not be expected to assist the separation, or when further stabilized and assured separation is required.

With the separating means 40 having the above structure, the central separation pawl 42 closest to the transfer material first enters the space between the transfer material P and the transfer material carrying sheet 34. With the advancement of the transfer material P, it is raised gradually to expand the separated region. Then, the auxiliary separating pawls **42*b* at both sides of the central separating pawl are introduced into the space between the transfer material P and the transfer material carrying sheet 34** to further expand the separated region to complete the separation therebetween.

Figure 18:
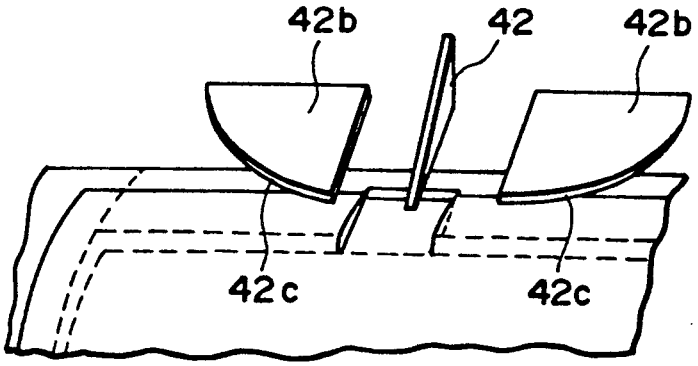
FIG. 18 is a perspective view of separating means equipped with an auxiliary separating member according to another embodiment of the present invention.

The auxiliary separating member **42*b* may be, in place of the auxiliary separating pawls 42*b* described above, in the form of quarter circular thin member disposed at predetermined angles as shown in FIG. 18**.

In this embodiment, the separation pawl 42 is made of a stainless steel plate having a thickness of 0.8 mm coated with tetrafluoroethylene resin, and the auxiliary separating pawls **42*b* are made of stainless steel plates having a thickness of 0.5 mm. Particularly, the auxiliary separating members 42*b* shown in FIG. 18 are preferably made of metal plates or flexible films (PET, for example). If there is burr at the curved edge 42*c*, the conveyance of the transfer material is affected, and therefore, it is preferable that the edge 42*c*** is abraded.

In this embodiment, the main separating function is provided by the central separating pawl 42 and only one separating pawl is inserted between the transfer material and the transfer drum at the time of the start of the separation therebetween. The auxiliary separating members, for example, the auxiliary separating pawls **42*b*, function to prevent the downward bending of the transfer material until the transfer material is conveyed from the transfer drum 5 to a conveying member. Accordingly, when the auxiliary separating pawl or pawls are used, the auxiliary separating pawl or pawls can go above the transfer material with the result of erroneous separation, depending on the position of the auxiliary separating pawl 42*b***.

The inventors have determined the relative proper positional relationship between the auxiliary separating pawl **42*b* and the separating pawl 42**.

Figure 17A:
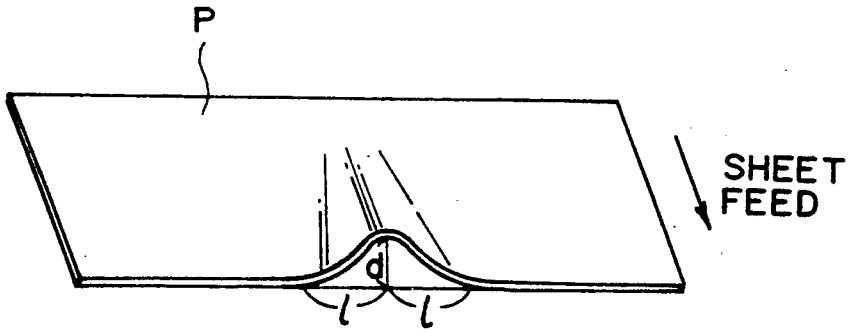
FIGS. 17A and 17B show the relationship between the raising amount of the transfer material and the separating pawl and the auxiliary separating pawl.

FIG. 17A illustrates the behavior of the transfer material when the transfer material P is being separated, wherein when the transfer material P is raised by an amount d, it is separated by a length 2l.

Figure 17B:
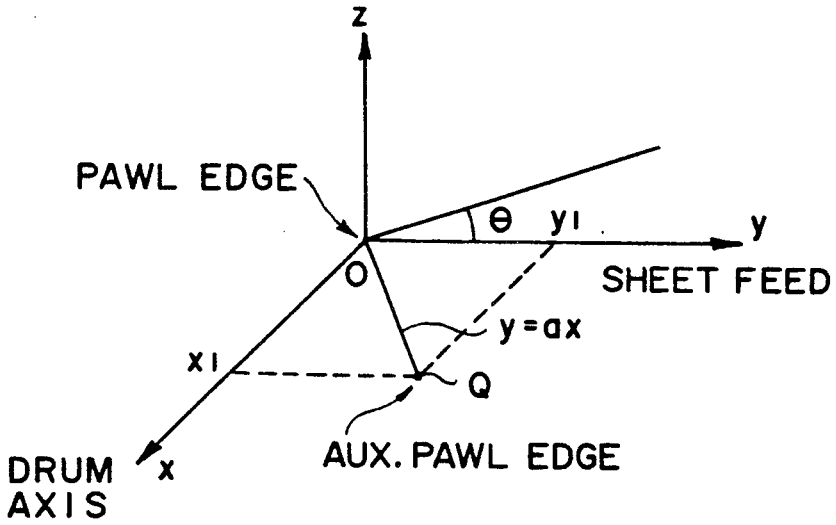

FIG. 17B shows the state wherein the separating pawl 42 and the auxiliary separating pawl **42*b* are arranged three dimensionally, wherein the angle $\theta$ is formed between the separating pawl 42 and a tangent of the transfer drum 30D at the separating point, and the edge of the separating pawl 42 is at the point of origin. The edge of the separating pawl 42*b* is placed at a point Q (x1, y1) on an x-y plane. The point Q is on a one-dimensional function expressed by $y=ax$ (a: constant). The amount of rise of the transfer material P is $ax_1 \tan\theta$. Since d and 2l** are proportionally changed with advancement of the sheet, $$x_1 : l = ax_1 \tan\theta : d$$

That is, $$a = d/l \tan\theta$$

The values d and l are empirically obtained as follows:

TABLE 1

| d (mm) | 1 | 2 | 3 | 4 |
|---|---|---|---|---|
| l (mm) | 6.2 | 12.0 | 17.8 | 24.0 |

Since $d/l = 1/6$, $a = 1/6 \times 1/\tan\theta$

Therefore, erroneous separation does not occur, if the following is satisfied:

$$y = 1/6 \cdot 1/\tan\theta \cdot x$$

which defines the position of the edge of the auxiliary separating pawl **42*b* relative to the separating pawl 42**.

With proper margin, $$y \geqq 1/6 \cdot 1/\tan\theta \cdot x$$

Figure 19:
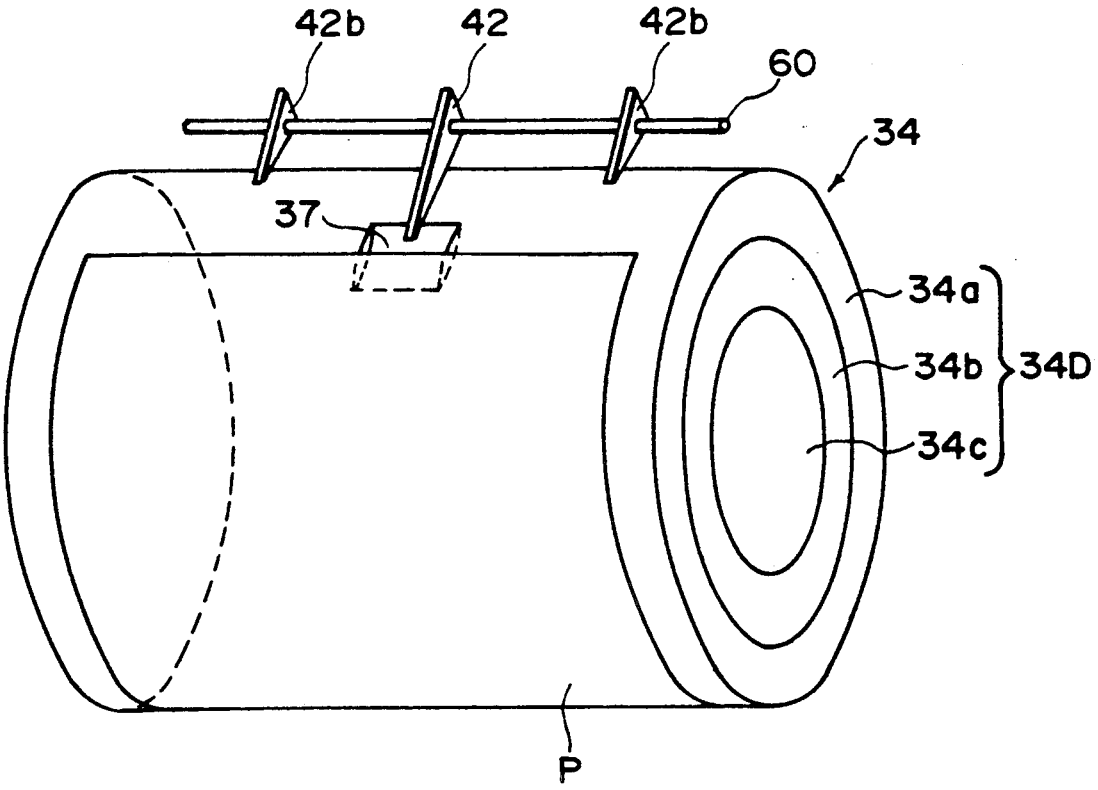
FIG. 19 is a perspective view of a transfer device according to another embodiment of the present invention.
Figure 20:
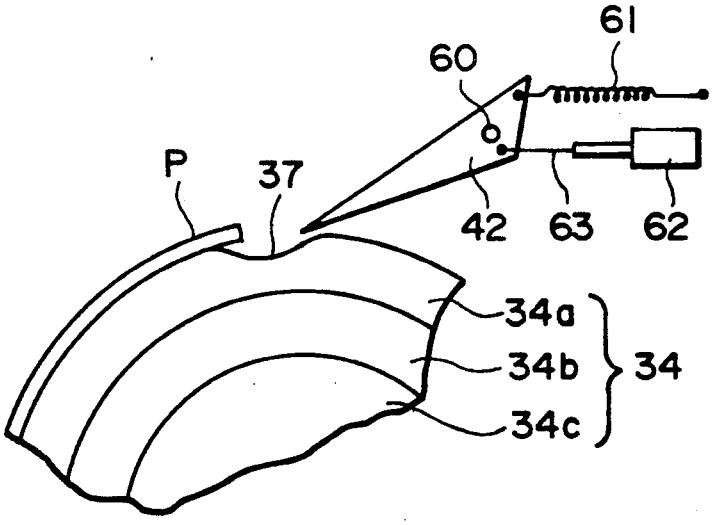
FIG. 20 is a sectional view of separating means of the transfer drum.

Referring to FIGS. 19 and 20, another embodiment of the present invention is shown. In this embodiment, the transfer device 30 includes a transfer drum 34*d* including a bias roller.

The transfer drum 34D includes an insulating layer 34*a* constituting a surface for carrying the transfer material P, a conductive layer 34*b* and an internal insulating layer 34*c*. At the central portion of the surface insulating layer 34*a* of the transfer drum 34*d*, there is formed a groove 37 for guiding the separating pawl to assist the separating pawl 32 to go into the space between the transfer material and the insulating layer 34*a*. In this embodiment, the separating pawl 42 and the auxiliary separating pawl 42*b* are supported on a supporting shaft 60, and normally, it is urged away from the transfer drum 34*d* surface by a spring 61 coupled to the separating pawl 42.

When the timing for separating the transfer material P now having the toner image to be separated from the transfer drum 34*d* is reached, the CPU produces a separating signal, in response to which the separating solenoid 62 is energized to pull a transmission wire 63. The wire 63 actuates the separating pawl 42 and the auxiliary separating pawl 42*b* to rotate the separating pawl 42 toward the surface of the transfer drum 34*d*. It then goes into the guiding groove 37 to start the separation of the transfer material P. After the transfer material P is completely separated from the transfer drum 30D, the separating solenoid 62 is deenergized, by which the separating pawl 42 is moved away from the transfer drum 30D.

In the foregoing embodiments, the description has been made with respect to a transfer device having a transfer drum wrapped with a dielectric sheet or a transfer drum in the form of a bias roller, but the present invention is applicable to a transfer member in the form of a belt in place of the drum.

In some of the above-described embodiments, the separating pawl 42 is shown as being located substantially at the longitudinal center of the transfer drum. This is shown as being usable for the case of central reference supply of the transfer material, and in the case of a lateral edge reference system, the separating pawl is placed at another position, more particularly, to the reference side lateral edge.

In the foregoing, the present invention has been described in conjunction with a color image forming apparatus, but the present invention is not limited to the apparatus wherein the images are superposedly transferred onto the transfer material, but is applicable to another image forming apparatus such as a monochromatic image forming apparatus provided with the transfer device. The transfer device is not limited to the cylindrical configuration.

As described in the foregoing, according to the present invention, there is provided an image forming apparatus wherein the recording material retained on the recording material carrying member is very efficiently separated from the recording material carrying member without damage to the recording material carrying member, thus providing good quality images.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image forming means for forming an image on a recording material;

a movable and flexible recording material carrying means for carrying the recording material to an image forming position where said image forming means is located; and separating means for separating the recording material carried by said recording material carrying means from said recording material carrying means, said separating means including means for deforming said recording material carrying means only when separating the recording material therefrom; wherein said recording material carrying means includes a sheet member which is deformed by said deforming means for separating the recording material from said recording material carrying means.

2. An apparatus according to claim 1, wherein said deforming means is movable between an operative position for separating the recording material and an inoperative position wherein it does not separate the recording material from the recording material carrying means.

3. An apparatus according to claim 2, further comprising driving means for moving said deforming means between the operative position and the inoperative position.

4. An apparatus according to claim 2, wherein said deforming means includes a pressing member for pressing said recording material carrying means at its side opposite from its side carrying the recording material.

5. An apparatus according to claim 2 or 4, wherein said deforming means include a pressing member for pressing said recording material carrying means at its side carrying the recording material.

6. An apparatus according to claim 5, wherein said separating means includes a separating member insertable between the recording material and said recording material carrying means upon the separating operation.

7. An apparatus according to claim 6, wherein the pressing member is integral with said separating member.

8. An apparatus according to claim 1, wherein said separating means includes a separating member insertable between the recording material and said recording material carrying means upon the separating operation.

9. An apparatus according to claim 8, wherein said separating member is a single separating member insertable between the recording material and said recording material carrying means at least upon start of the separating operation.

10. An apparatus according to claim 9, wherein said separating means includes an auxiliary separating member for assisting separation, by the separating member, of the recording material from said recording material carrying means.

11. An apparatus according to claim 10, wherein said auxiliary separating member is disposed downstream of said separating member with respect to the movement direction of said recording material carrying means.

12. An apparatus according to claim 11, wherein a plurality of said auxiliary separating members are provided, which are disposed more downstream of said separating member away from said separating member, with respect to the movement direction of said recording material carrying means.

13. An apparatus according to claim 9, wherein said single separating member is disposed at a reference position for the recording material to be carried by said recording material carrying means.

14. An apparatus according to claim 8, wherein said separating member is movable between an operative position for separating the transfer material and an inoperative position for not separating the transfer material.

15. An apparatus according to claim 14, further comprising driving means for driving said separating member between the operative position and the nonoperative position.

16. An apparatus according to claim 8, wherein said separating member is a separating pawl.

17. An apparatus according to claim 1, further comprising recording material attracting means for electrostatically attracting the recording material to said recording material carrying means.

18. An apparatus according to claim 1, wherein said recording material carrying means is capable of carrying plural recording materials.

19. An apparatus according to claim 1, wherein said recording material carrying means is capable of carrying a different number of recording materials depending on the sizes of the recording materials.

20. An apparatus according to claim 18 or 19, wherein the number of recording materials carried by said recording material carrying means is changeable depending on the number of image forming operations on the recording materials.

21. An apparatus according to claim 1, wherein said recording material carrying means is in the form of a drum and includes ring members at longitudinal ends, a connecting portion for connecting the ring portions and a sheet member covering an opening defined by said ring portions and said connecting portion.

22. An apparatus according to claim 1, wherein said separating means executes different operations depending on the positions of the recording materials carried on said recording material carrying means.

23. An image forming apparatus, comprising:

a movable image bearing member;

image forming means for forming an image on said image bearing member;

transfer means for transferring the image from said image bearing member to a recording material;

a movable and flexible recording material carrying means for carrying the recording material to move the recording material to a transfer position where said transfer means is located; and separating means for separating the recording material carried by said recording material carrying means from said recording material carrying means, said separating means including deforming means for deforming said recording material carrying means upon separation of the recording material from said recording material carrying means.

24. An apparatus according to claim 23, wherein said recording material carrying means includes a sheet member which is deformed by said deforming means for separating the recording material from said recording material carrying means.

25. An apparatus according to claim 23, wherein said deforming means is movable between an operative position for separating the recording material and an inoperative position wherein it does not separate the recording material from the recording material carrying means.

26. An apparatus according to claim 25, further comprising driving means for moving said deforming means between the operative position and the inoperative position.

27. An apparatus according to claim 25, wherein said deforming means includes a pressing member for pressing to said recording material carrying means at its side opposite from its side carrying the recording material.

28. An apparatus according to claim 25 or 27, wherein said deforming means includes a pressing member for pressing said recording material carrying means at its side carrying the recording material.

29. An apparatus according to claim 28, wherein said separating means includes a separating member insertable between the recording material and said recording material carrying means upon the separating operation.

30. An apparatus according to claim 29, wherein the pressing member is integral with said separating member.

31. An apparatus according to claim 23, wherein said separating means includes a separating member insertable between the recording material and said recording material carrying means separating operation.

32. An apparatus according to claim 31, wherein said separating member is a single separating member insertable between the recording material and said recording material carrying means at least upon start of the separating operation.

33. An apparatus according to claim 32, wherein said separating means includes an auxiliary separating member for assisting separation, by the separating member, of the recording material from said recording material carrying means.

34. An apparatus according to claim 33, wherein said auxiliary separating member is disposed downstream of said separating member with respect to movement direction of said recording material carrying means.

35. An apparatus according to claim 24, wherein a plurality of said auxiliary separating members are provided, which are disposed more downstream of said separating member away from said separating member, with respect to the movement direction of said recording material carrying means.

36. An apparatus according to claim 32, wherein said single separating member is disposed at a reference position for the recording material to be carried by said recording material carrying means.

37. An apparatus according to claim 31, wherein said separating member is movable between an operative position for separating the recording material and an inoperative position for not separating the recording material.

38. An apparatus according to claim 37, further comprising driving means for driving said separating member between the operative position and the nonoperative position.

39. An apparatus according to claim 31 wherein said separating member is a separating pawl.

40. An apparatus according to claim 23, further comprising recording material attracting means for electrostatically attracting the recording material to said recording material carrying means.

41. An apparatus according to claim 23, wherein said recording material carrying means is capable of carrying plural recording materials.

42. An apparatus according to claim 41, wherein said recording material carrying means is capable of carrying a different number of recording materials depending on the sizes of the recording materials.

43. An apparatus according to claim 41 or 42, wherein the number of recording materials carried by said recording material carrying means is changeable depending on the number of image forming operations on the recording materials.

44. An apparatus according to claim 41, wherein when plural recording materials are to be separated from the recording material carrying means, said deforming means operates for the respective recording materials.

45. An apparatus according to claim 23, wherein said recording material carrying means is in the form of a drum and includes ring members at longitudinal ends, a connecting portion for connecting the ring portions and a sheet member covering an opening defined by said ring portions and said connecting portion.

46. An apparatus according to claim 45, wherein said separating means operates differently depending on whether or not the connection portion is at the leading edge of the recording material carried on said recording material carrying means.

47. An apparatus according to claim 46, wherein said deforming means operates only when the connecting portion is not at the leading edge of the recording material.

48. An apparatus according to claim 45, wherein said separating means includes a separating member for inserting between the connection portion and the recording material carrying means, and said connecting portion has an opening for receiving said separating member.

49. An apparatus according to claim 48, wherein when the leading edge of the recording material is at the opening of the connecting portion, said deforming means does not effect the deforming operation.

50. An apparatus according to claim 23, wherein said separating means executes different operations depending on the positions of the recording materials carried on said recording material carrying means.

51. An apparatus according to claim 23, wherein said recording material carrying means rotates a plurality of times to transfer plural images onto one and the same recording material from said image bearing member.

52. An apparatus according to claim 51, wherein different images are formed on said image bearing member and transferred onto the recording material by said transfer means.

53. An image forming apparatus, comprising:

a movable image bearing member;

means for transferring the image from said image bearing member onto a recording material;

movable recording material carrying means for carrying the recording material to a transfer position where said transfer means is located; and separating means for separating the recording material carried by said recording material carrying means from said recording material carrying means, said separating means having a first separating member which is first inserted between the recording material and said recording material carrying means and a second separating member which is inserted therebetween after the first separating member is inserted.

54. An apparatus according to claim 53, wherein said separating member is movable between an operative position for separating the recording material and an inoperative position for not separating the recording material.

55. An apparatus according to claim 54, further comprising driving means for driving said separating member between the operative position and the nonoperative position.

56. An apparatus according to claim 53, wherein said separating means includes a pressing member for pressing said recording material carrying means at its side carrying the recording material.

57. An apparatus according to claim 56, wherein the pressing member is integral with said separating member.

58. An apparatus according to claim 53, wherein said separating member is a separating pawl.

59. An apparatus according to claim 53, further comprising recording material attracting means for electrostatically attracting the recording material to said recording material carrying means.

60. An apparatus according to claim 17, 40 or 59, wherein said attracting means first carries the recording material on said recording material carrying means.

61. An apparatus according to claim 53, wherein said second separating member is disposed downstream of said first separating member with respect to a movement direction of said recording material carrying means.

62. An apparatus according to claim 53, wherein a plurality of said second separating members are provided, which are disposed downstream by progressively farther distances from said first separating member with respect to the movement direction of said recording material carrying means.

63. An apparatus according to claim 61 or 62, wherein only one such first separation member is provided, and said first separating member is disposed at a reference position for the recording material to be carried by said recording material carrying means.

64. An apparatus according to claim 53, wherein said recording material carrying means is capable of carrying plural recording materials.

65. An apparatus according to claim 64, wherein said recording material carrying means is capable of carrying a different number of recording materials depending on the sizes of the recording materials.

66. An apparatus according to claim 64 or 65, wherein the number of recording materials carried by said recording material carrying means is changeable depending on the number of image forming operations on the recording materials.

67. An apparatus according to claim 53, wherein said recording material carrying means is in the form of a drum and includes ring members at longitudinal ends, a connecting portion for connecting the ring portions and a sheet member covering an opening defined by said ring portions and said connecting portion.

68. An apparatus according to claim 53, wherein said separating means executes different operations depending on positions of the recording materials carried on the said recording material carrying means.

69. An apparatus according to claim 53, wherein said recording material carrying means rotates a plurality of times to transfer plural images onto one and the same recording material from said image bearing member.

70. An apparatus according to claim 69, wherein different images are formed on said image bearing member and transferred onto the recording material by said transfer means.

71. An apparatus according to claims 51 or 69, wherein a full-color image is formed on the recording material after the transfer.

72. An image forming apparatus, comprising:

image forming means for forming an image on a recording material;

a movable and flexible recording material carrying means for carrying the recording material to an image forming position where said image forming means is located; and separating means for separating the recording material carried by said recording material carrying means from said recording material carrying means, said separating means including means for deforming said recording material carrying means only when separating the recording material therefrom;

wherein said separating means includes a separating member insertable between that side of the recording material which does not have the image and said recording material carrying means upon a separating operation.

73. An apparatus according to claim 72, wherein said deforming means is movable between an operative position for separating the recording material and an inoperative position wherein it does not separate the recording material from the recording material carrying means.

74. An apparatus according to claim 73, wherein said deforming means includes a pressing member for pressing toward said recording material carrying means at its side opposite from its side carrying the recording material.

75. An apparatus according to claim 73 or 74, wherein said deforming means including a pressing member for pressing toward said recording material carrying means at its side carrying the recording material.

76. An apparatus according to claim 75, wherein the pressing member is integral with said separating member.

77. An apparatus according to claim 76, wherein the separating member is a separating pawl.

78. An apparatus according to claim 72, wherein said separating member is movable between an operative position for separating the transfer material and an inoperative position for not separating the transfer material.

79. An apparatus according to claims 72 or 78, wherein the separating member is a separating pawl.

80. An apparatus according to claim 72, further comprising recording material attracting means for electrostatically attracting the recording material to said recording material carrying means.

81. An apparatus according to claim 72, wherein said separating member is disposed at a reference position for the recording material to be carried by said recording material carrying means.

82. An apparatus according to claim 72, wherein said recording material carrying means is in the form of a drum and includes ring members at longitudinal ends, a connecting portion for connecting the ring portions and a sheet member covering an opening defined by said ring portions and said connecting portion.

* * * * *

UNITED STATES PATENT AND TRADEMARK OFFICE

CERTIFICATE OF CORRECTION

PATENT NO. : 5,130,758

DATED : July 14, 1992

INVENTOR(S) : Takeda et al

It is certified that error appears in the above-indentified patent and that said Letters Patent is hereby corrected as shown below:

COLUMN 12

Line 68, "deformed" should read --deform--.

COLUMN 18

Line 56, "claim 31" should read --claim 31,--.

COLUMN 19

Line 19, "connection" should read --connecting--.
Line 28, "connection" should read --connecting--.

UNITED STATES PATENT AND TRADEMARK OFFICE

CERTIFICATE OF CORRECTION

PATENT NO. : 5,130,758

DATED : July 14, 1992

INVENTOR(S) : Takeda et al

It is certified that error appears in the above-indentified patent and that said Letters Patent is hereby corrected as shown below:

COLUMN 20

Line 33, "claim 61" should read --claim 53, 61--.
Line 58, "on" (first occurrence) should read --on the--
Line 59, "the" should be deleted.

COLUMN 22

Line 4, "including" should read --includes--.

Signed and Sealed this

Fourteenth Day of September, 1993

Bruce Lehman

*Attest:*

BRUCE LEHMAN

*Attesting Officer*

*Commissioner of Patents and Trademarks*